United States Patent [19]

Everson et al.

[11] Patent Number: 4,530,686

[45] Date of Patent: Jul. 23, 1985

[54] ROTARY PACKAGING TECHNOLOGY

[76] Inventors: William G. Everson, P.O. Box 145, Crosby, Minn. 56441; Richard D. Stevens, 196 Harrington Dr., Long Lake, Minn. 55356

[21] Appl. No.: 438,780

[22] Filed: Nov. 3, 1982

[51] Int. Cl.[3] ..... B31B 1/80

[52] U.S. Cl. ..... 493/315; 493/431

[58] Field of Search ..... 493/315, 318, 319, 431

[56] References Cited

U.S. PATENT DOCUMENTS

| | | | |
|---|---|---|---|
| 938,364 | 10/1909 | Bechman | 493/431 |
| 2,915,308 | 12/1959 | Matzen | 271/95 |
| 3,302,946 | 2/1967 | Anderson | 271/95 |
| 3,385,595 | 5/1968 | Benetar et al. | 271/95 |
| 3,633,470 | 1/1972 | Pitters | 493/315 |
| 3,937,458 | 2/1976 | Langen | 271/95 |
| 3,956,976 | 5/1976 | Vogel | 493/315 |

*Primary Examiner*—Leon Gilden

*Attorney, Agent, or Firm*—Anthony G. Eggink

[57] ABSTRACT

The carton erecting apparatus provides for the high speed transfer and opening of flat, folded cartons. The apparatus includes a rotary transfer mechanism having a fixed gear and a plurality of planetary gears in rotational communication with the fixed gear. The planetary gearing rotationally drives therewith a vacuum transport means so as to provide therefor at least two apex positions of travel at predetermined locations. A vacuum control means is operative on the transport means, particularly at its apex positions. A storage means is provided at a first apex position for releasably holding flat, folded cartons. And, a conveyor means is provided at a second apex position of travel of the vacuum transport means. The conveyor means has outwardly extending flights which are uniformly spaced and separated by a distance essentially based upon a predetermined carton dimension. The conveyor means is synchronized with the rotary transfer means so that a carton carried by the vacuum transport means slidably engages an upwardly extending flight as it approaches the second apex position of travel. The slidable engagement of the flight and carton causes the carton to open in a sleeve-like configuration. The vacuum release by the vacuum control means provides for the deposit of the opened carton between adjacent flights for transfer therewith and for subsequent packaging purposes.

20 Claims, 4 Drawing Figures

ROTARY PACKAGING TECHNOLOGY

This invention relates to packaging technology utilizing rotary transfer mechanisms. Particularly, this invention relates to a carton erecting apparatus which utilizes a rotary transfer mechanism for the high-speed transfer and opening of flat, folded cartons.

It has become increasingly important and necessary, from both a competative and economic standpoint, to mechanize various operations in the packaging industry. And, particularly, it has become necessary to mechanize these operations in a high-speed and reliable manner. The carton erecting apparatus of this invention provides for the continual transfer of flat, folded cartons, by means of a rotary transfer mechanism, to a time and space synchronized conveyor means, to open the cartons into a sleeve-like configuration for subsequent packaging purposes.

Several types of rotary transfer mechanisms have been proposed or utilized in the past in conjunction with generally unrelated packaging type machines. However, these rotary mechanisms, by design, have been limited to particular or specific packaging purposes. Additionally, some of these prior art rotary mechanisms utilize drive means which are inherently subject to malfunction, and, otherwise, subject to use limitations, and, therefore, not suitable for use in high-speed carton erecting operations.

For example, several types of prior art machines utilize a rotary transfer mechanism for the placement of coupons or other light weight materials to a predetermined and fixed location. Other machines, although designed for carton erecting purposes, utilize a number of linearly operative vacuum devices which inherently diminishes the speed at which the cartons are erected. Other devices utilize gear/chain drives in conjunction with their respective transfer mechanisms, and are, consequently, difficult to adjust and maintain, and are cumbersome in construction.

The carton erecting apparatus of this invention overcomes the problems, difficulties and shortcomings of those prior art devices discussed above. And, the carton erecting apparatus according to this invention provides a reliable, high-speed mechanism which is versatile in nature to permit its use in a variety of packaging settings.

In summary, this invention provides a carton erecting apparatus particularly suited for the high-speed transfer of flat, folded cartons from a storage supply location to a synchronized, flighted conveyor means. The apparatus is space and time synchronized whereby the cartons are erected or opened by slidably engaging the flighted conveyor means, and are deposited thereon for subsequent packaging purposes.

The carton erecting apparatus includes a rotary transfer mechanism having a fixed gear and a plurality of planetary gears in rotational communication with the fixed gear. Vacuum operated transport means, to engage and disengage individual cartons, are rotationally driven by the planetary gearing in a manner so that at least two outwardly extending apex positions are realized at predetermined locations. A vacuum control means in communication with the vacuum transport means is operative thereon, particularly at its respective apex positions of travel.

A storage means is provided at a first apex position for the releasable storage of a supply of flat, folded cartons, and which permits the removal of individual cartons by the vacuum operated transport means. A conveyor means having upwardly extending flights is provided at a second apex position of travel of the vacuum transport means. The flights are uniformly spaced at a distance which is essentially based on a predetermined carton dimension.

The conveyor means is synchronized with the vacuum transport means and the vacuum control means. As a carton being transported by the vacuum transport means in a predetermined direction reaches the second apex position, the carton engages a forward surface of a continually moving flight of the conveyor means. This slidable engagement, in conjunction with the vacuum held carton by the transport means, causes the carton to open into a sleeve-like configuration, for example. As the transport means leaves its second apex position, the vacuum control means releases the vacuum operative on the transport means to permit the opened carton to be transported between adjacent flights of the conveyor means for subsequent packaging purposes, such as the filling and closing of the carton. The transport means continues its rotary motion, and, subsequently, removes another flat, folded carton from the storage means. Thus, a continual supply of flat, folded cartons are provided for opening, and are supplied in an erected state on a continually moving conveyor means.

Additionally provided by the invention are shut-off means which ceases the rotation of the transfer mechanism and/or the conveyor means should the storage means be depleted of cartons, or should the transport means not have a carton attached when its particular position of travel so requires. And, provided are elements, such as, adjustment means, and power means, which further enhance the use and function of the carton erecting apparatus of this invention.

These and other benefits of this invention will become clear from the following description, by reference to the drawings, wherein.

Figure 3:
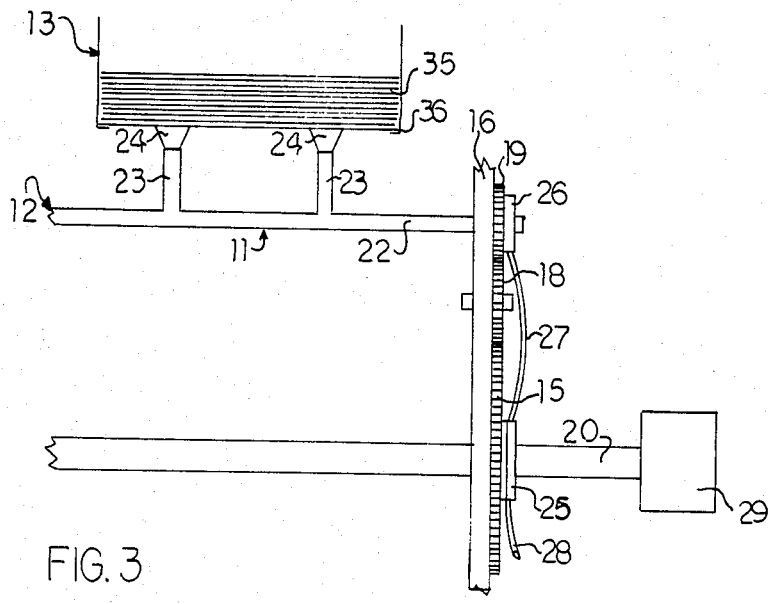
Figure 4:
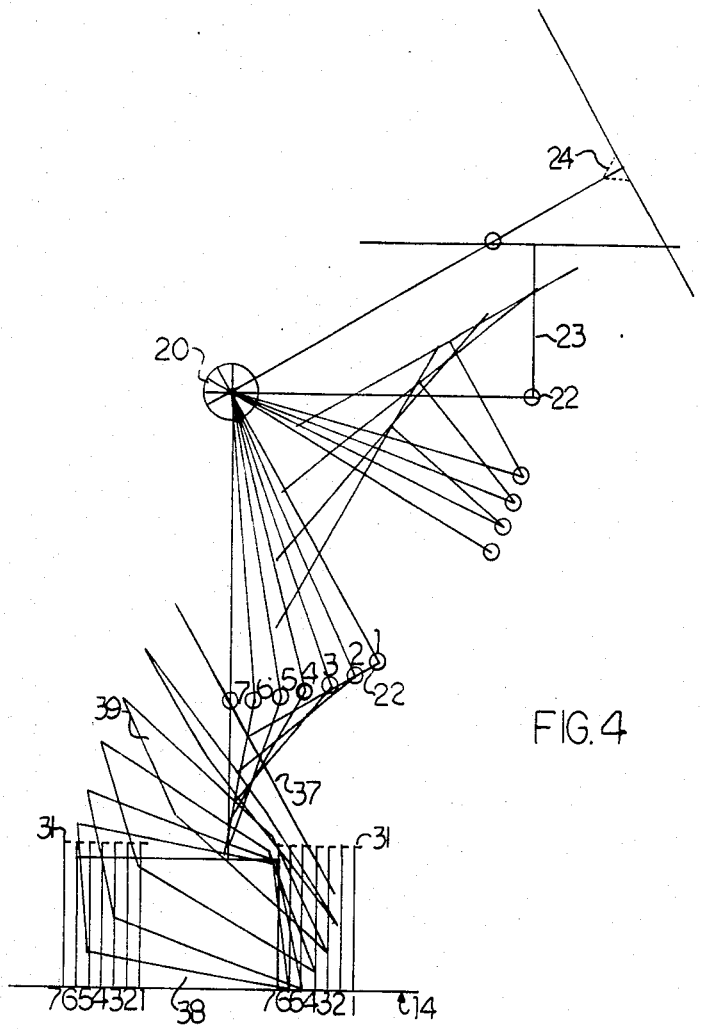

FIG. 3 is a schematic top view of a portion of the carton erecting apparatus of this invention, and which particularly shows the rotary transfer mechanism, the vacuum transport means and the carton storage means; and, FIG. 4 is a schematic, geometric, time-location diagram which shows the opening process of a flat, folded carton at the second apex position as a carton slidably engages a flight of the synchronized conveyor means.

Figure 1:
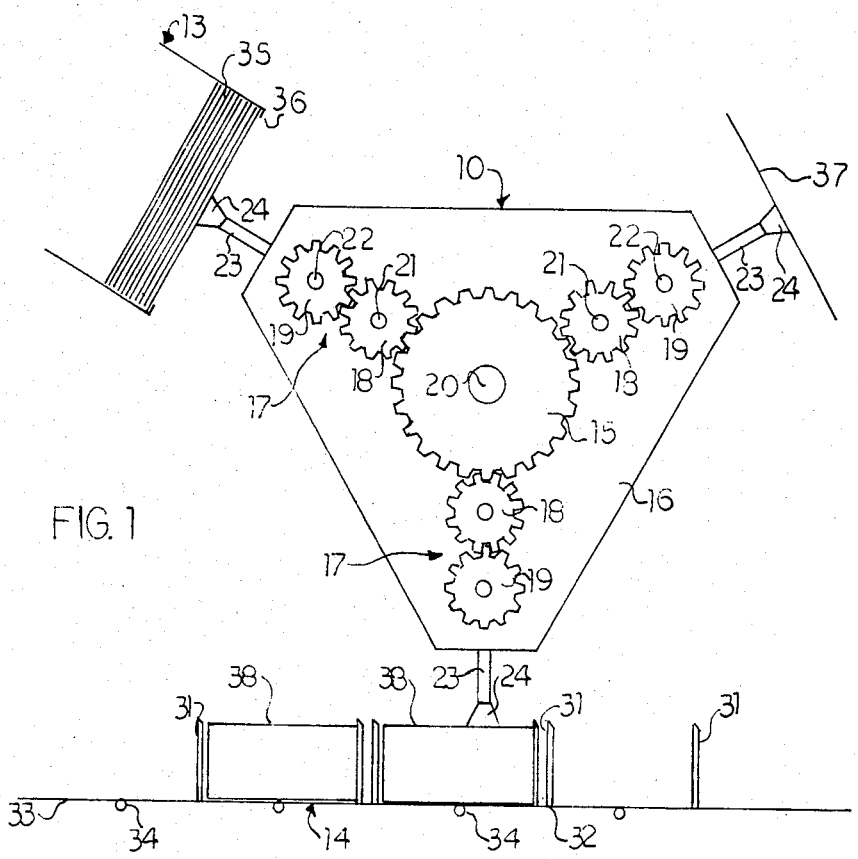
FIG. 1 is a schematic side plan view of the carton erecting apparatus of this invention.

Referring to FIG. 1, a carton erecting apparatus according to the teachings of this invention is there illustrated. The apparatus is shown as having rotary transfer mechanism 10, a carton storage means 13, and a conveyor means 14.

The rotary transfer mechanism 10 has a rotary head or plate 16, a fixed gear 15 and three planetary gears, shown generally as 17. The planetary gears 17 are in rotational communication with fixed gear 15, and consist of inner or idler gears 18 and outer or drive gears 19. The inner gears 18 and outer gears 19 are mounted for rotation with the rotary plate 16 by means of journaled shafts 21 and 22, respectively.

With reference to FIG. 3, the embodiment and operation of rotary transfer mechanism 10 is more clearly understood. A shaft 20 which is in communication with a drive means 29, such as a motor, extends horizontally and perpendicularly through the center of fixed gear 15 and rotary plate 16. The rotary plate 16 rotates with the drive shaft 20, while the fixed gear 15 is journaled with respect thereto, and does not rotate therewith.

The shaft 22 is in rotational communication with outer gear 19, and rotates therewith. Additionally, shafts 22 are hollow to permit communication with a vacuum source, and extending perpendicularly therefrom are vacuum cup shafts 23 having heads or rubber cups 24 at their respective ends. The latter elements, namely, hollow shafts 22 and 23, and cups 24, make up the vacuum transport means, generally referred to as 11.

The vacuum control means of the apparatus is generally referred to as 12, and the vacuum control means is directly operative on the vacuum transport means 11. As shown in FIG. 3, a rotationallly communicating pair of internally ported discs 25 is located axially at shaft 20. This vacuum control means arrangement is generally known in the art, and it generally functions as one disc rotates along with shaft 20, while the communicating disc remains stationary. A conduit or hose 28 is in direct communication with a vacuum source, while conduit 27 is in communication with a hollow member 26 which is in communication with the shaft 22 of vacuum transport means 11. Thus, as drive shaft 20 and rotary plate 16 are driven by power means 29, the predetermined ports within the pair of rotating discs 25 communicate in a manner so as to provide a vacuum source and to provide a vacuum release operative on cups or heads 24 through hollow shaft 22.

Figure 2:
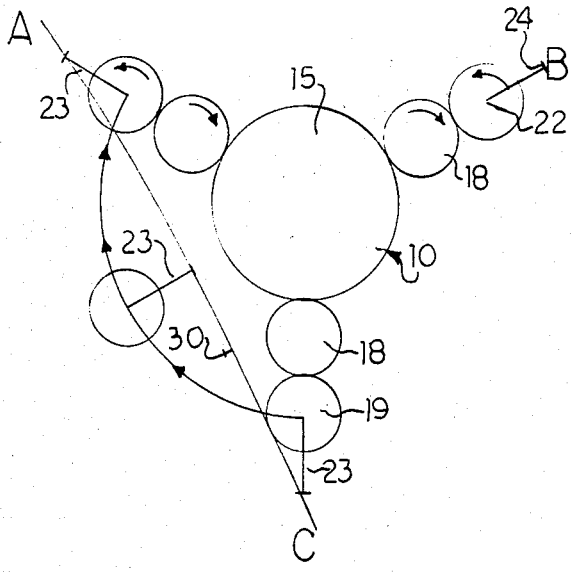
FIG. 2 is a schematic geometric diagram showing the path of travel of the vacuum transport means of this invention, and which shows the apex positions of the transport means for a rotary transfer mechanism having three sets of planetary gears in rotational communication with the fixed gear.

As previously described, the planetary gears 17 rotate with respect to fixed gear 15 as the rotary plate 16 is rotationally driven. And, depending upon the gear ratio of the outer gear 19 with respect to that of fixed gear 15, a predetermined and fixed path of travel will result for the transport means 11, which directly rotates with outer gear 19. This gear ratio, as shown particularly, in FIGS. 1, 2 and 4, is 3:1. Thereby, with respect to the carton erecting apparatus shown, three apex positions for the transport means 11 results.

FIG. 2 particularly illustrates the path of travel for transport means 11, whereby the above mentioned gear ratio is 3:1. As a result, three apex positions, namely, A, B and C are realized for vacuum heads 24. Also clearly shown by this geometric diagram are the relative rotations of inner gears 18 and outer gears 19 with respect to fixed gear 15 as the rotary transfer mechanism 10 is rotated in a clockwise direction. And, particularly, line 30 indicates the path of travel of vacuum head 24.

For purposes of the teachings of this invention, with respect to the carton erecting apparatus, it is only essential that two apex positions are realized. First, at one apex position, carton storage means 13 is located so that a vacuum head 24 can readily remove an individual carton 37 from the flat, folded carton supply 35 as the vacuum control means 12 provides a vacuum source therethrough. The flat, folded carton supply 35 is releasable stored by means of a lipped magazine 36.

Importantly, to effectuate the carton erecting function, a synchronized conveyor means 14 is located below the rotary transfer mechanism 10, at a second apex position of transport means travel. The conveyor means 14 includes a continuous chain or other flexible material 33, to which outwardly extending or upright flights 31 are attached. The chain 33 continually moves on rollers 34, for example, as the apparatus is functioning. It has been found that the utilization of the same drive means 29 is suitable, so that the proper time synchronization can be easily obtained. Additionally, for control purposes, the utilization of one power source, i.e., for the rotary transfer mechanism and for the conveyor means, ensures that both portions operate and shut-off simultaneously. Thus, once synchronized with time, through gearing, etc., the synchronization will remain.

The spacing between adjacent flights 31 is essentially based upon a predetermined carton dimension, as can be seen in FIGS. 1 and 4. And, although FIG. 1 illustrates two opposing flights 31 to receive and transport an erected carton 38, the closely adjacent flights can clearly be contiguous so that one flight 31 serves, respectively, to contain two adjacent erected cartons 38. And, as mentioned above, flights 31 are attached to chain 33 so that a spacing is provided between adjacent flights to properly open and to receive an erected carton 38; however, adjustable flight attachment means 32 can be provided so that the apparatus can be utilized for multiple carton size erecting purposes.

FIG. 4 particularly illustrates the required location and time synchronization of a flat, folded carton 37 transported by at least one vacuum head 24 with respect to the forwardly extending facial surface of a flight 31 of conveyor means 14. As shown, in a series of steps, numbered 1 through 7, the forwardly extending fold of carton 37 slidably engages the frontal surface of flight 31 as vacuum head 24 is in engaging communication with one of the carton walls. After reaching an intermediate configuration of erection, as shown by 39, the forward fold of the carton engages the bottom intersection of the flight/conveyor, and, subsequently, after the sleeve-like configuration (in cross-section) has been attained by the carton, as shown by 38, the vacuum control means causes the release of vacuum between the vacuum head 24 and the carton. The erected carton continues onward between adjacent flights 31 for subsequent packaging purposes, and the vacuum head travels upward to engage another flat, folded carton from the storage means.

Although the teachings of this invention can clearly be utilized for a variety of packaging or article transport and placement purposes, the carton erecting function of the apparatus herein disclosed requires unique time and location synchronization requirements between the various operative elements of the apparatus.

It should be noted, that depending upon particular flat, folded carton dimensions, that a properly sized inner gear may be required to ensure clearance, and that flights of proper height be provided to ensure the necessary slidable engagement.

Additionally, rotationally adjustable communicating ported discs can be provided to permit the adjustability of the vacuum control means. And, remote vacuum timing devices utilizing a solenoid valve arrangement in conjunction with limit switches to activate the valve, could also be utilized.

It is in the purview of the invention to provide an apparatus wherein the rotary transfer mechanism, transport means, vacuum control means and, optionally, the storage means is provided on a separate frame or stand, for subsequent synchronization with a flighted conveyor means, for example. In the latter case, however, remote synchronization means must be provided, such as the use of photocell arrangements, as known in the art. Preferably, however, the elements as recited herein, suitably mounted on a unitary frame structure and utilizing a single power source results in a more reliable arrangement. The single power source permits the synchronization of the elements through positive linkage by known mechanical means, such as chain/gear, gear/-gear, or other known drive means.

It is further within the purview of the invention to utilize an increased number of planetary gears (inner and outer gears) and varying gearing ratios (outer gear to fixed gear) which result in an increased number of apex positions of the respective transport means. An increased feed rate, and the ability to provide other functional positions, such as second storage means or hot melt dispensing can thus be provided for the apparatus.

Additionally, no-product-no placement means, shut-off means, and counter means can also be incorporated into the teachings of this invention.

As many changes are possible to the embodiments of this invention, utilizing the teachings thereof, the description above and the accompanying drawings, should be viewed in the illustrative and not in the limited sense.

That which is claimed is:

1. A rotary carton erecting apparatus to continuously transfer and open flat, folded cartons to and from radially disposed locations for subsequent packaging purposes, said apparatus utilizing a continuous rotary and orbital movement for the high speed, damage resistent transfer of packaging cartons, said carton erecting apparatus comprising:

(a) a rotary transfer mechanism having a fixed gear and a plurality of planetary gears in rotational communication with said fixed gear, said planetary gears having an inner idler gear and an outer drive gear, said inner gear being in rotational communication with said fixed gear and said outer gear being in rotational communication with said inner gear, said outer gear further being essentially smaller than said fixed gear, (b) vacuum transport means to engage and disengage individual cartons, said transport means being in communication for rotational movement with said rotary transfer mechanism, said vacuum transport means further being in fixed rotational communication with each said outer gear of said planetary gears for providing orbital motion to the cartons transferred, said orbital motion of said vacuum means further providing at least two outwardly extending apex positions, (c) vacuum control means being operative on said vacuum transport means, particularly at said apex positions, (d) storage means located at one said apex position for the releasable storage of flat, folded cartons, and, (e) conveyor means having outwardly extending flights attached thereto, said flights being separated by a distance essentially based on a predetermined carton dimension, said conveyor means further being synchronized with said rotary transfer mechanism so that two adjacent conveyor flights are located at a predetermined location as said vacuum transport means approaches said second apex position, whereby, said rotary transfer mechanism with said vacuum control means operative on said vacuum transport means continually provides for the removal of individual, flat, folded cartons from said storage means at said first apex position, and provides for the continual opening of individual cartons into a sleeve-like configuration by causing flat, folded cartons to slidably engage said outwardly extending flights of said conveyor means located at said second apex position.

2. The carton erecting apparatus in claim 1, wherein said apparatus additionally has a rotary plate for concentric rotation relative to said fixed gear, said rotary plate for rotationally supporting said planetary gears.

3. The carton erecting apparatus of claim 1, wherein said apparatus additionally has a rotary plate for concentric rotation relative to said fixed gear, said rotary plate being for rotationally supporting said planetary gears, said outer gear further being rotationally supported by said rotary plate by means of a journaled, hollow shaft, said hollow shaft for releasably holding a vacuum.

4. The carton erecting apparatus of claim 3, wherein said vacuum transport means further comprises at least one vacuum head extending outwardly from said hollow shaft, said vacuum head being for direct contact with cartons to be erected.

5. The carton erecting apparatus of claim 1, wherein said conveyor means further comprises at least one continuous length of flexible material, said length of flexible material further having a series of apertures therein for the releasable fastening thereto of said flights.

6. The carton erecting apparatus of claim 1, wherein said apparatus further has power means, said power means for synchronizably driving said rotary transfer mechanism and said conveyor means.

7. The carton erecting apparatus of claim 1, wherein said apparatus additionally has shut-off means in communication with said vacuum transport means, whereby said rotary transfer mechanism and said conveyor means ceases operation should said transport means fail to remove a carton from said storage means.

8. A rotary carton erecting apparatus to continuously transfer and open flat, folded cartons to and from radially disposed locations for subsequent packaging purposes, said apparatus utilizing a continuous rotary and orbital movement for the high speed, damage resistent transfer of packaging cartons, said carton erecting apparatus comprising:

(a) a rotary transfer mechanism having a fixed gear and a plurality of planetary gears in rotational communication with said fixed gear, said planetary gears having an inner idler gear and an outer drive gear, said inner gear being in rotational communication with said fixed gear and said outer gear being in rotational communication with said inner gear, said outer gear further being essentially smaller than said fixed gear, (b) a rotary plate member for concentric rotation relative to said fixed gear and being for rotationally supporting said planetary gears, said outer gear gear further being mounted for rotation to said rotary plate by means of a journaled hollow shaft for releasably holding a vacuum, (c) vacuum transport means to engage and disengage individual cartons, said transport means being in communication for orbital movement with said hollow journaled shaft for providing orbital motion to the cartons transferred, said rotary transfer mechanism further providing at least two outwardly extending apex positions of travel, (d) vacuum control means being operative on said vacuum transport means, particularly at said apex positions, (e) storage means located at one said apex position for the releasable storage of flat, folded cartons, and (f) conveyor means having outwardly extending flights attached thereto, said flights being separated by a distance essentially based on a predetermined carton dimension, said conveyor means further being synchronized with said rotary transfer mechanism so that two adjacent conveyor flights are located at a predetermined location as said vacuum transport means approaches said second apex position, whereby, said rotary transfer mechanism with said vacuum control means operative on said vacuum transport means continually provides for the removal of individual, flat, folded cartons from said storage means at said first apex position, and provides for the continual opening of individual cartons into a sleeve-like configuration by causing flat, folded cartons to slidably engage said outwardly extending flights of said conveyor means located at said second apex position.

9. The carton erecting apparatus of claim 8, wherein said vacuum transport means further comprises at least one vacuum head extending outwardly from said hollow shaft, said vacuum head being for direct contact with cartons to be erected.

10. The carton erecting apparatus of claim 8, wherein said conveyor means further comprises at least one continuous length of flexible material, said length of flexible material further having a series of apertures therein for the releasable fastening thereto of said flights.

11. The carton erecting apparatus of claim 8, wherein said apparatus further has power means, said power means for synchronizably driving said rotary transfer mechanism and said conveyor means.

12. The carton erecting apparatus of claim 8, wherein said apparatus additionally has shut-off means in communication with said vacuum transport means, whereby said rotary transfer mechanism and said conveyor means ceases operation should said transport means fail to remove a carton from said storage means.

13. The carton erecting apparatus of claim 8, wherein said apparatus has three sets of planetary gears and three vacuum transport means and wherein said gear ratio between said fixed gear and said outer gears is 3:1.

14. A rotary packaging apparatus to continuously transfer packaging materials to and from radially disposed locations for subsequent packaging purposes, said apparatus utilizing a continuous rotary and orbital movement for the high speed, damage resistent transfer of packaging materials and being for use with a synchronized conveyor, said rotary packaging apparatus comprising:

(a) a frame for supporting the elements of the apparatus, (b) a rotary transfer mechanism having a fixed gear and a plurality of planetary gears in rotational communication with said fixed gear, said planetary gears having an inner idler gear and an outer drive gear, said inner gear being in rotational communication with said fixed gear and said outer gear being in rotational communication with said inner gear, said outer gear further being essentially smaller than said fixed gear, (c) vacuum transport means to engage and disengage packaging materials, said transport means being in communication for rotational movement with said rotary transfer mechanism, said vacuum transport means further being in fixed rotational communication with each said outer gear of said planetary gears for providing orbital motion to the cartons transferred, said orbital motion of said vacuum means further providing at least two outwardly extending apex positions, (d) vacuum control means being operative on said vacuum transport means and essentially at said apex positions, and (e) storage means located at one said apex position for the releasable storage of packaging materials.

15. The rotary packaging apparatus of claim 14, wherein said vacuum transport means further comprises at least one vacuum head extending outwardly from said hollow shaft, said vacuum head being for direct contact with the packaging material.

16. The rotary packaging apparatus of claim 14, wherein said apparatus additionally has shut-off means in communication with said vacuum transport means, whereby said rotary transfer mechanism ceases operation should said transport means fail to remove packaging material from said storage means.

17. The rotary packaging apparatus of claim 14, wherein said apparatus has three sets of planetary gears and three vacuum transport means and wherein the gear ratio between said fixed gear and said outer gears is 3:1.

18. The rotary packaging apparatus of claim 14, wherein said apparatus additionally has a rotary plate for concentric rotation relative to said fixed gear, said rotary plate being for rotationally supporting said planetary gears, said outer gear futher being rotationally supported by said rotary plate by means of a journaled, hollow shaft, said hollow shaft for releasably holding a vacuum.

19. The rotary packaging apparatus of claim 18, wherein said vacuum transport means further comprises at least one vacuum head extending outwardly from said hollow shaft, said vacuum head being for direct contact with the packaging materials for transfer.

20. The carton erecting apparatus of claim 1, wherein said apparatus has three sets of planetary gears and three vacuum transport means and wherein the gear ratio between said fixed gear and said outer gear is 3:1.

* * * * *